US006305714B1

(12) United States Patent
Rossetto et al.

(10) Patent No.: US 6,305,714 B1
(45) Date of Patent: Oct. 23, 2001

(54) FOLDER WITH FRAMED WINDOWS AND METHOD OF MANUFACTURING THEREOF

(75) Inventors: Paul Rossetto, Oak Creek, WI (US); James Joseph Steger, Chicago; Patricia Forrest, Oak Park, both of IL (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/346,689

(22) Filed: Jul. 2, 1999

(51) Int. Cl.[7] ..... B42C 7/00; B42F 13/00

(52) U.S. Cl. ..... 281/37; 281/29; 281/31; 281/51; 402/4; 402/70; 402/73; 40/700; 40/725; 40/726; 40/775; 40/768; 40/777

(58) Field of Search ..... 281/31, 37, 29, 281/51; 402/4, 70, 73; 40/725, 726, 700, 775, 777, 768

(56) References Cited

U.S. PATENT DOCUMENTS

| | | | |
|---|---|---|---|
| 170,042 | 11/1875 | Anthony . | |
| D. 289,530 | 4/1987 | Arrington | D19/27 |
| D. 293,335 | 12/1987 | Egly | D19/27 |
| D. 313,619 | 1/1991 | Moor | D19/27 |
| D. 350,983 | 9/1994 | Penniman | D19/26 |
| 498,761 | 6/1893 | Becker . | |
| 868,998 | 10/1907 | Lang . | |
| 1,023,834 | 4/1912 | Gareis . | |
| 1,029,280 | 6/1912 | Davidson . | |
| 1,330,894 | 2/1920 | Muffley . | |
| 1,381,674 | 6/1921 | Simpson . | |
| 1,435,762 | 11/1922 | Tomsich . | |
| 1,677,277 | 7/1928 | Federbush et al. . | |
| 1,865,741 | 7/1932 | Carney . | |
| 2,088,672 | 8/1937 | Steinthal | 40/152 |
| 2,239,145 | 4/1941 | Doner | 281/15 |
| 2,477,840 | 8/1949 | Vasilas | 150/35 |

(List continued on next page.)

FOREIGN PATENT DOCUMENTS

| | | |
|---|---|---|
| 77388 | 4/1918 | (CH) . |
| 313 576 | 6/1956 | (CH) . |
| 683411 | 3/1994 | (CH) . |
| 2713880 | 7/1978 | (DE) . |
| 2656021 | 8/1980 | (DE) . |
| 0 106 405 | 4/1984 | (EP) . |
| 0 183 660 | 6/1986 | (EP) . |
| 1.279.118 | 11/1961 | (FR) . |
| 2639747 | 6/1990 | (FR) . |
| 332119 | 7/1930 | (GB) . |
| 363876 | 12/1931 | (GB) . |
| 2030074 | 4/1980 | (GB) . |
| 175 812 | 6/1961 | (SE) . |
| 200 241 | 12/1965 | (SE) . |
| WO 92/21524 | 12/1992 | (WO) . |

*Primary Examiner*—Willmon Fridie, Jr.
*Assistant Examiner*—Mark T. Henderson
(74) *Attorney, Agent, or Firm*—Pennie & Edmonds LLP

(57) ABSTRACT

A folder having framed windows featuring a first panel, a second panel and a spine panel disposed between the covers. A pocket panel secured to the holder providing framed windows in substantial alignment with the front cover and the spine such that a sheet containing content information is insertable within the pocket and displayable over the front cover, spine or a combination thereof. A mounting sheet is insertable within the pocket for securing a sheet containing content identification. The mounting sheet has a plurality of fasteners adaptable for securing and displaying sheets for insertion into the pocket in multiple orientations. In the first orientation, the plurality of fasteners secures the sheet such that it extends over the front cover and is viewable only within the framed window of the front cover. In the second orientation, the fasteners secure the sheet such that it extends over both the front cover and the spine and is viewable within both framed windows. In both orientations, the framed windows cover the fasteners from view.

26 Claims, 7 Drawing Sheets

U.S. PATENT DOCUMENTS

| | | | | |
|---|---|---|---|---|
| 2,523,129 | | 9/1950 | Maier | 224/47 |
| 2,532,132 | | 11/1950 | Vogel | 40/124 |
| 2,544,566 | | 3/1951 | Rose | 281/31 |
| 2,568,178 | | 9/1951 | Widder | 40/158 |
| 2,616,431 | | 11/1952 | Kalwajtys | 129/20 |
| 2,639,168 | | 5/1953 | Coppock | 283/168 |
| 2,639,254 | | 5/1953 | Smith | 154/116 |
| 2,701,426 | * | 2/1955 | Vlock | 40/159 |
| 2,704,546 | | 3/1955 | Slonneger | 129/1 |
| 2,801,115 | | 7/1957 | Federbush et al. | 281/31 |
| 2,828,975 | | 4/1958 | Wright | 281/19 |
| 2,842,882 | | 7/1958 | Greene et al. | 40/158 |
| 2,852,275 | | 9/1958 | Brook | 281/31 |
| 2,935,807 | | 5/1960 | Townsend, Jr. et al. | 40/158 |
| 3,133,750 | | 5/1964 | Gerald | 281/34 |
| 3,175,847 | | 3/1965 | McKowen | 281/36 |
| 3,252,462 | | 5/1966 | Quarton et al. | 129/38 |
| 3,431,667 | | 3/1969 | Woods | 40/158 |
| 3,473,246 | | 10/1969 | Parobek | 40/124.4 |
| 3,492,743 | | 2/1970 | Schmidt | 35/26 |
| 3,589,049 | | 6/1971 | Cornelius | 40/152 |
| 3,663,041 | | 5/1972 | White | 281/46 |
| 3,810,324 | | 5/1974 | Hart | 40/158 R |
| 3,814,527 | | 6/1974 | Lawes | 402/3 |
| 3,822,495 | | 7/1974 | Ohfuji | 40/158 |
| 4,001,960 | | 1/1977 | Holson | 40/159 |
| 4,164,085 | * | 8/1979 | Steeb et al. | 281/31 |
| 4,275,517 | | 6/1981 | Blanchard | 40/158 R |
| 4,294,469 | | 10/1981 | Errichiello | 281/29 |
| 4,315,642 | | 2/1982 | Errichiello | 281/33 |
| 4,378,647 | | 4/1983 | Stancato | 40/158 |
| 4,420,112 | | 12/1983 | Cline | 229/72 |
| 4,600,346 | | 7/1986 | Podosek | 412/3 |
| 4,629,349 | * | 12/1986 | Pitts | 281/31 |
| 4,681,472 | | 7/1987 | Ruble | 402/3 |
| 4,828,421 | | 5/1989 | Arakaki | 403/3 |
| 4,830,404 | | 5/1989 | Lu | 281/2 |
| 4,832,369 | | 5/1989 | Johnson et al. | 281/18 |
| 4,838,724 | | 6/1989 | Spence, Jr. | 402/79 |
| 4,848,798 | | 7/1989 | Moor | 281/31 |
| 4,856,817 | | 8/1989 | Moor | 281/29 |
| 4,886,299 | | 12/1989 | Ducorday | 281/31 |
| 4,890,728 | | 1/1990 | Grimsley | 206/0.81 |
| 4,892,333 | | 1/1990 | Krulich | 281/15.1 |
| 4,934,739 | | 6/1990 | Stancato | 281/38 |
| 4,962,951 | | 10/1990 | Mechesney | 283/114 |
| 4,991,767 | | 2/1991 | Wyant | 229/1.5 R |
| 4,998,840 | | 3/1991 | Ruble | 402/3 |
| 5,015,011 | | 5/1991 | York | 281/18 |
| 5,020,828 | | 6/1991 | Moor | 281/29 |
| 5,030,027 | | 7/1991 | Bachrach et al. | 402/4 |
| 5,059,052 | | 10/1991 | Casper | 402/80 R |
| 5,090,732 | | 2/1992 | Kuhns et al. | 281/29 |
| 5,213,368 | | 5/1993 | Wyant | 281/18 |
| 5,222,825 | | 6/1993 | Wyant | 402/76 |
| 5,265,359 | * | 11/1993 | Glazer et al. | 281/22 |
| 5,330,279 | | 7/1994 | Ruble | 402/3 |
| 5,330,281 | * | 7/1994 | Kalan | 281/22 |
| 5,351,992 | | 10/1994 | Chilsone t al. | 281/31 |
| 5,411,293 | | 5/1995 | Monzyk | 281/31 |
| 5,437,514 | | 8/1995 | Minch | 402/79 |
| 5,445,417 | | 8/1995 | Bromer et al. | 281/46 |
| 5,490,739 | | 2/1996 | Olson | 402/79 |
| 5,562,309 | | 10/1996 | Brink et al. | 281/15.1 |
| 5,607,246 | | 3/1997 | Podosek | 402/73 |
| 5,620,207 | | 4/1997 | Podosek et al. | 281/29 |
| 5,651,628 | | 7/1997 | Bankes et al. | 402/73 |
| 5,660,514 | | 8/1997 | Wilson | 412/1 |
| 5,671,950 | | 9/1997 | Hanson | 281/29 |
| 5,674,021 | | 10/1997 | Hutnick | 402/14 |
| 5,711,627 | | 1/1998 | Chapman | 402/3 |
| 5,720,564 | | 2/1998 | Winzen | 402/3 |
| 5,762,375 | | 6/1998 | Kogutt et al. | 281/37 |
| 5,826,851 | | 10/1998 | Arbisi | 248/466 |
| 5,836,507 | * | 11/1998 | Mueller et al. | 229/71 |
| 5,857,797 | * | 1/1999 | Streff et al. | 402/4 |
| 5,876,143 | | 3/1999 | Ong | 402/3 |
| 5,882,038 | | 3/1999 | Ong | 281/31 |
| 6,045,161 | | 4/2000 | Aschcraft et al. | 281/37 |

* cited by examiner

FOLDER WITH FRAMED WINDOWS AND METHOD OF MANUFACTURING THEREOF

FIELD OF THE INVENTION

This invention relates generally to folders. More particularly, this invention is directed to a folder or a loose-leaf binder comprising a cover having first and second panels and a mounting portion connected to the cover for securing a display sheet in different positions.

BACKGROUND OF THE INVENTION

Folders and loose-leaf binders are conventionally used for holding and organizing sheets of paper. Loose-leaf binders typically have front and back covers and a spine disposed between the covers. Additionally, ring segments that abut to form rings are incorporated in the inside surface of these binders, either along the spine or the back cover, to allow the insertion of paper to or removal of paper from the binder. To further facilitate the organization and identification of the sheets of paper held within the folder or binder, content identifiers such as labels are generally affixed to the spine, front cover, or both. Although the area available for an inscription is more limited, content identifiers have been displayed on the spine of these folders or binders to provide identification when they are stored in the upright position either on a shelf or a desk top. Displaying content identifiers on the front cover allows the user more inscription space in displaying titles or graphics, but is only visible when the binders are laid flat.

Various forms of content identifiers are known in the art and have been incorporated into binders. The simplest form is attaching inscribed self-adhesive labels to either the front cover or the spine of the binder. Also commonly used are transparent plastic materials, typically rectangular in shape, that are either heat sealed or adhesively attached to the spine or the front cover into which a label can be inserted.

Improvements have developed in content identifiers for binders to enhance both usage versatility and visual appeal. U.S. Pat. No. 5,857,797 discloses a three-ring binder having a spine, front cover and back cover. The spine and the front cover each includes a rectangular frame aligned with and welded to the bottom and side edges of the spine and cover. A clear plastic membrane is secured to the frame's interior and covers the opening in the picture frames. A display insert is dimensioned for inserting into each of the picture frames.

U.S. Pat. No. 2,704,546 discloses a ring binder having a transparent cover with a framed border and an interior pocket opening alongside the spine for holding a title sheet. The ring mechanism is connected to the spine and content identification is provided only on the covers. Both references require separate identification for the spine and the covers.

Another reference allowing customized insertion of a content identifier in an exterior window is U.S. Pat. No. 5,720,564. This reference teaches a binder having a single sheet of transparent plastic material wrapping around the spine and extending to at least a portion of the front and back covers to form a single pocket. The pocket is formed to hold a label made from a conventional 8.5 by 11-inch sheet of paper.

The Avery® Framed View Binder™ has two individually framed label pockets, with one extending over the front cover and the other extending over the spine. A spine label is first printed and either must be manually retrofitted to the size necessary for fitting into the pocket on the spine or printed on a pre-sized label which minimizes the inscription options available to a user. Thereafter, a cover sheet is separately prepared for insertion into the pocket on the front cover. Although the spine label or cover sheet can be printed using conventionally sized 8½ by 11-inch paper on a widely popular laser printer, the printed sheet must thereafter cut into size to fit in both pockets. Moreover, the spine label and cover sheet can easily shift out of position when the binder is handled, mis-aligning the printed materials with respect to the front cover. U.S. Pat. No. 5,445,417 discloses a three-ring binder having full length pockets with opaque framing applied by silk screening. The pockets are heat sealed to the front and back covers such that identification is not available on the spine.

SUMMARY OF THE INVENTION

A folder with framed windows according to the present invention features a first panel, a second panel and a spine panel disposed between the covers. A pocket secured to the holder provides framed windows in substantial alignment with the front cover and the spine such that a sheet containing content information is insertable within the pocket and displayable over the front cover, spine or a combination thereof. In another embodiment, cut-outs are provided within the front cover and the spine forming framed windows. A pocket is secured to the inside surface of the binder to allow the insertion of a sheet containing content information to be displayed through the windows.

Also, the present invention reduces the probability of the display sheet or spine label from getting loose when the binder is dropped or transported by providing a mounting sheet insertable within the pocket. The mounting sheet has a plurality of fasteners adaptable for securing and displaying sheets in multiple orientations. In the first orientation, the plurality of fasteners secures the sheet such that it extends over the front cover and is viewable only within the framed window of the front cover. In the second orientation, the fasteners secure the sheet such that it extends over both the front cover and the spine and is viewable within both framed windows. In both orientations, the window frames cover the fasteners from view.

The present invention is also directed to a method manufacturing a folder comprising the steps of forming a base by layering a board between a first and second cover material such that the first cover material is on top. A mounting sheet is located over the base, covering a portion of the base. A pocket sheet is placed over the mounting sheet atop of the base such that the pocket sheet covers the mounting sheet. The pocket sheet is affixed to the base by radio frequency welding the edges of the pocket sheet to the base such that at least one seal line abuts the mounting sheet. Once the pocket sheet is sealed onto the base, the edges are trimmed along the seal line.

DESCRIPTION OF THE PREFERRED EMBODIMENT

Figure 1:
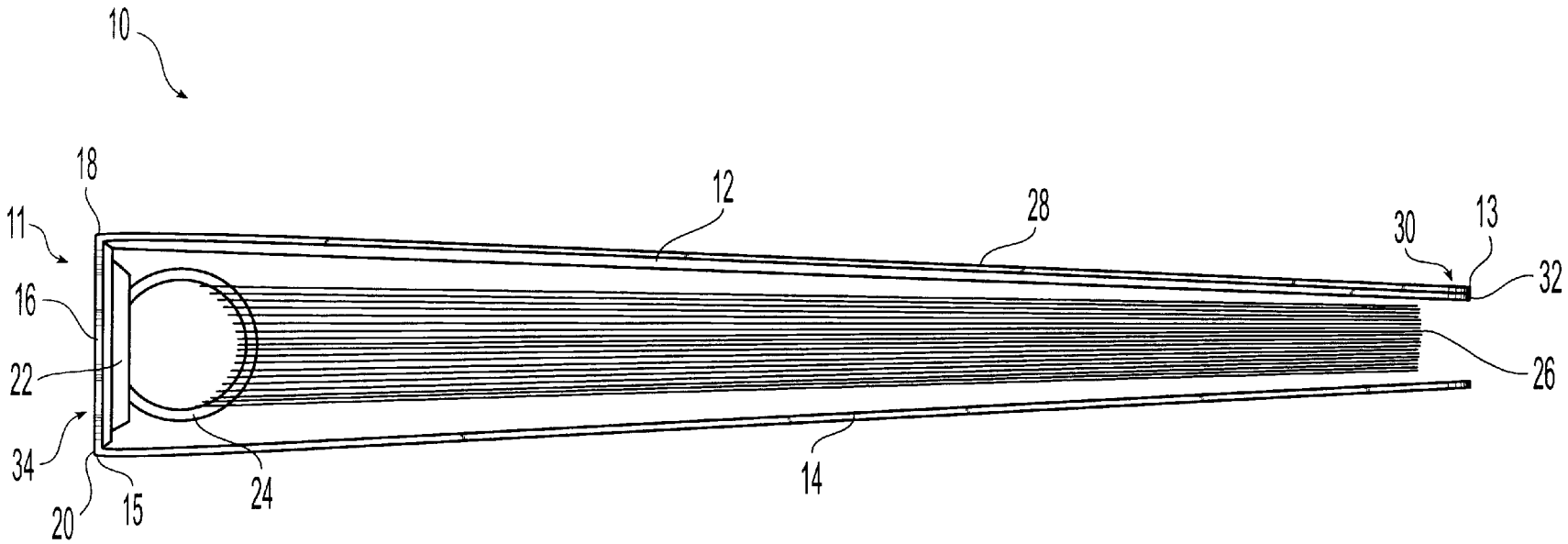
FIG. 1 is a side view of a folder according to the present invention.
Figure 2:
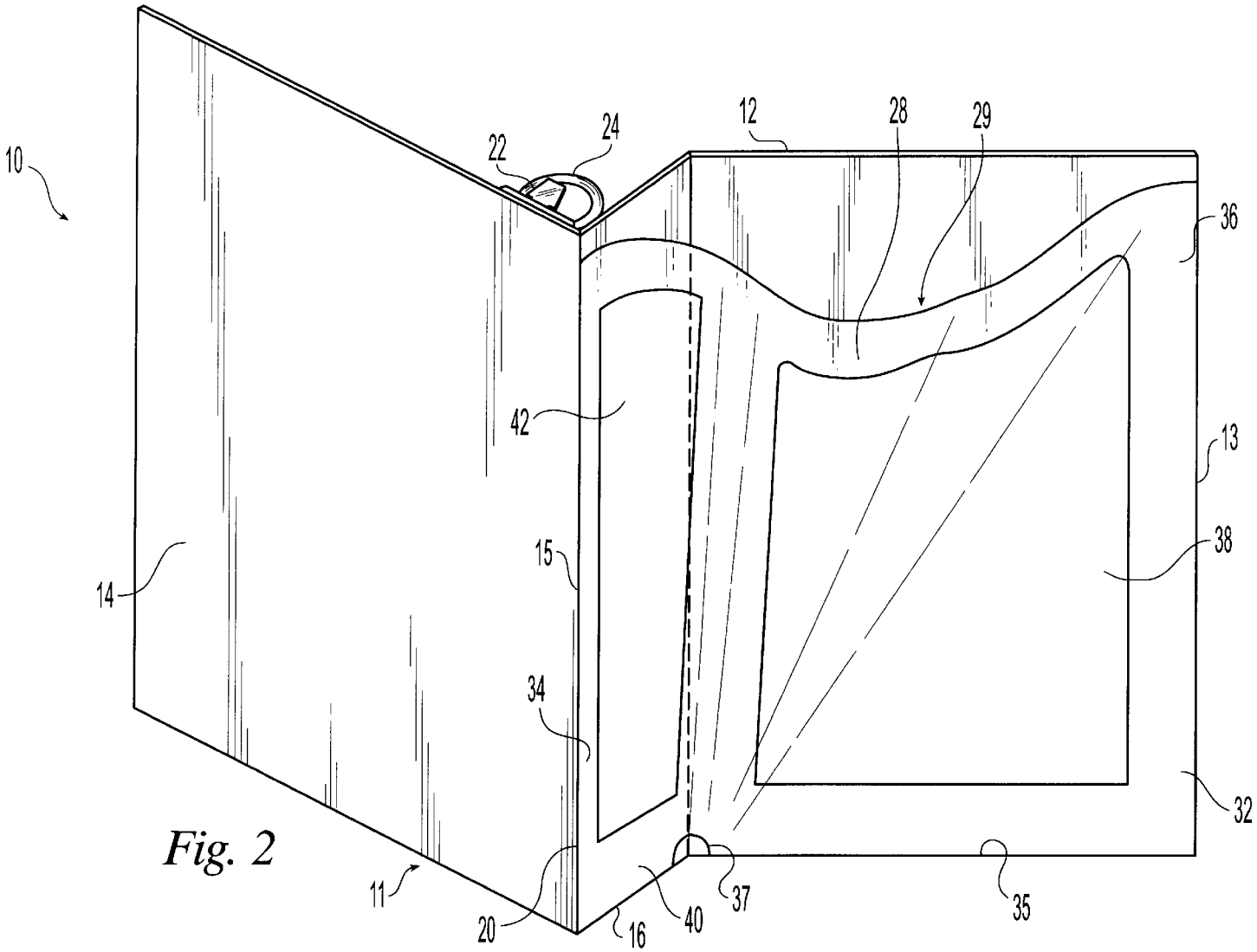
FIG. 2 is a perspective view of a folder in an open position according to the present invention.

Referring to FIGS. 1 and 2, a sheet holder such as a folder or a binder according to an embodiment of the present invention is shown. As shown in FIG. 1, the folder 10 comprises a binder 11 preferably having a front cover 12, a back cover 14 and a spine 16 disposed therebetween. The spine 16 defines a front fold line 18 forming a hinge, and a back fold line 20 at the respective interfaces with the front cover 12 and the back cover 14. The folder 10 of the preferred embodiment in FIG. 1 is shown as a conventional loose-leaf binder that comprises a ring binder mechanism 22, which is preferably a ring binder as shown, but may otherwise be other known mechanisms for securing sheets 26. The binder mechanism 22 is secured to the inside surface of the folder 10 and preferably has at least one ring 24, and more preferably 3 rings 24, for holding at least one sheet, a display sheet 33, between the front and back covers 12 and 14.

The ring binder mechanism 22 may be secured to the inside surface of the front or back cover 12 and 14, preferably proximate to the back fold line 20 as shown in FIG. 2 or laterally centered on the spine 16 between the front and back fold lines 18 and 20 as shown in FIG. 1. The rings 24 may comprise ring segments that abut to form substantially circular rings to facilitate the insertion or removal of sheets 26 to and from the folder 10. Alternative rings 24 may have one segment that is substantially semi-circular while the other substantially straight, forming a "D" shaped rings when the segments abut to form a closed configuration as shown in FIG. 2.

The folder 10 has a mounting portion, which includes pockets, mounting sheets, clips attached to the binder, cut-outs on the binder allowing the insertion of materials. The preferred mounting portion is shown in FIG. 2, having a pocket panel 28 has a first side 30 connected adjacent an outer edge 32 of the front cover 12 preferably by heat sealing to form a first sealed edge 13. A second side 34 of the pocket panel 28 is connected to the binder 11 of the folder 10 along or near the back fold line 20 preferably forming a second sealed edge 15, which is on a side of the spine 16 opposite from the outer edge 32. As shown in FIG. 2, the pocket panel 28 is thus secured to the binder 11 to form a pocket 29. The pocket 29 extends over the front cover 12 and the spine 16. A display sheet 33 with content inscriptions may be inserted in the pocket 29 as will be described in greater details hereafter. Referring to FIG. 2, folder 10 is shown with the front and back covers 12 and 14 opened in such a manner that the pocket panel 28 reveals a wide open pocket 29 allowing greater ease in inserting the display sheet. A third side 35 of the pocket panel 28 is also preferably connected to the base of the binder 11 and extends along the base of the front cover 12 and the spine 16.

Preferably a cut-out 37 is positioned on the pocket panel 28 in alignment with the front fold line 18 around the base of the hinge, between the front cover 12 and the spine 16 before the pocket panel 28 is secured to the binder 11. The cut-out may alternatively not be provided, but the effect of connecting the pocket panel 28 to the binder 11 about the back fold line 20 may create a gathering of excess pocket panel 28 material along the hinge area between the front cover 12 and the spine 16, making the pocket panel 28 difficult to fold about the back fold line 18. One advantage of cut-out 37, therefore, is to facilitate the folding of the pocket panel 28 about the front fold line 18 when the pocket panel 28 is sealed to the base of the folder 11, preventing the gathering of excess material. Additionally, the cut-out 37 prevents the pocket panel 28 from pinching the mounting sheet 44, which will be discussed hereinafter. Preferably, the cut-out 37 has a semicircular shape to allow greater ease in the insertion and removal of the display sheet 33. The preferred method of connecting the pocket panel 28 to the binder 11 is sealing by radio frequency welding, as will be discussed hereinafter. Other connecting methods known in the art, including stitching, stamping, snapping, riveting, adhering, pressing and fastening, are also suitable for forming fold lines 18 and 20 and connecting the pocket panel 28 to the binder 11.

Figure 4:
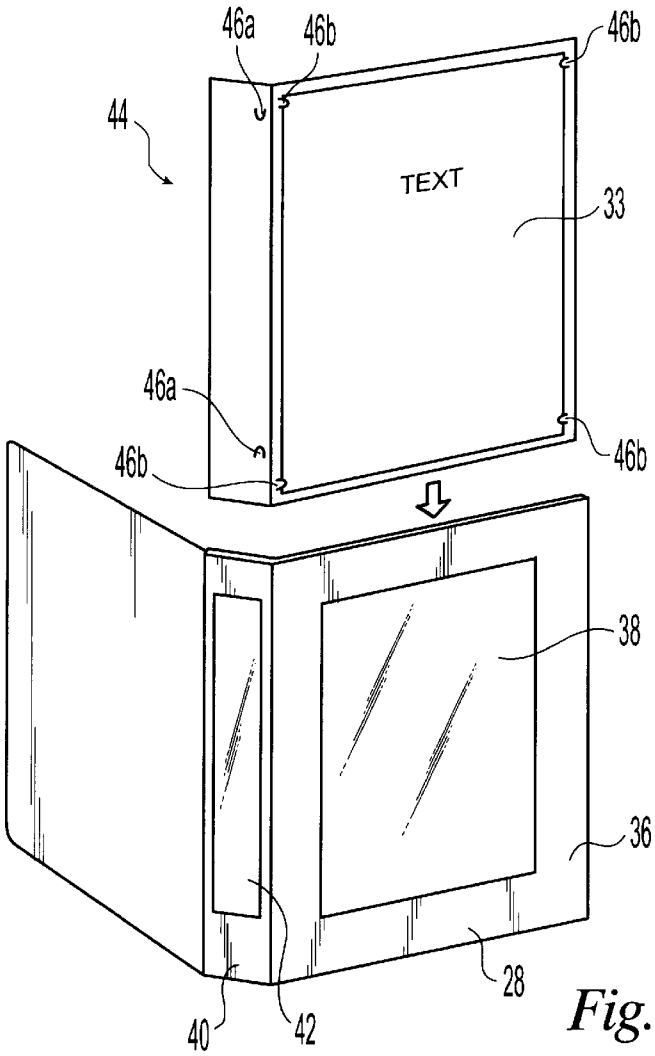
FIG. 4 is another embodiment of the binder if FIG. 2 showing the insertion of the mounting sheet with the sheet in a second orientation.
Figure 3:
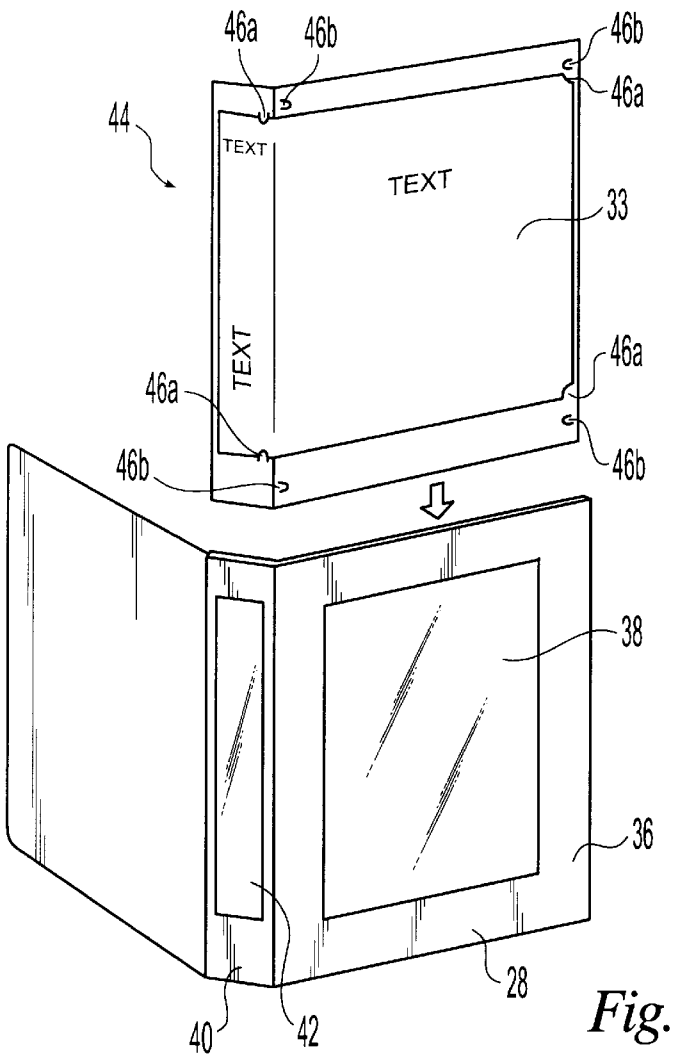
FIG. 3 is a perspective view of the binder in FIG. 2 showing the insertion of a mounting sheet with a sheet in a first orientation.

As previously stated, pocket panel 28 allows the insertion of the display sheet 33 to indicate the contents thereof or for decorative purposes. As a part of the present invention, a mounting sheet 44 is provided to facilitate the insertion of the display sheet 33 into the pocket 29, as shown in FIGS. 3 and 4. Preferably the mounting sheet 44 is constructed of a pliable, semi-rigid plastic material. The most preferred material is a plastic coated paper material commercially know as a Yupo™ sheet, which is sold by Yupo Corporation. The mounting sheet 44 has at least one and preferably a plurality of fasteners 46*a* and 46*b* for securing the display sheet 33 for insertion into the pocket 29 as shown in FIGS. 3 and 4. The fasteners 46*a* and 46*b* are arranged to secure the display sheet 33 in various positions. FIG. 3 shows the display sheet 33 in a first position, known as landscape, where the display sheet 33 is secured by a first set of fasteners 46*a* in an orientation allowing the display sheet 33 to span both the front cover 12 and the spine 16 portions of the pocket panel 28. FIG. 4 shows the mounting sheet 44 with a display sheet 33 fitted in a second position, preferably portrait, where the display sheet 33 is secured by a second set of fasteners 46*b* in an orientation allowing the display sheet 33 to span only the front cover 12 portion of the pocket panel 28.

In both FIGS. 3 and 4, mounting sheet 44, once fitted with the display sheet 33 containing inscriptions or other information, is receivable within the pocket 29 by sliding the mounting sheet 44 in the direction of the arrows. The frames 36 and 40 are preferably dimensioned to cover fasteners 46*a* and 46*b*, or concealing them from view by overlapping the fasteners 46*a* and 46*b*. The contents of the display sheet 33 are displayed for view through windows 38 and 42.

A third variation is also available in which the first and second positions are used in combination. A user may print two display sheets 33, one for insertion into the first set of fasteners 46*a*, but containing only spine label information, and the other display sheet 33 inserted in the second set of fasteners 46*b* containing cover information. The two display sheets 33 are each secured to the mounting sheet 44 preferably using different sets of fasteners 46*a* and 46*b* before inserting the mounting sheet 44 into the pocket 29 of the folder 10. The display sheet 33 is preferably smaller than the front cover 12 and spine 16 combined to suitably fit within the pocket 29. Most preferably, the display sheet 33 has the same dimensions as sheets 26 contained in the binder 11. A user may conveniently print information on the display sheet 33 along with the sheets 26 that are intended for the binder 11. Such an identification system allows the user the ease and flexibility of using conventionally available printer technology and office supplies to create a visually appealing display sheet, spine label, or a combination thereof that not only identifies the contents of the folder but also enhances the overall appearance of the folder 10.

Figure 5:
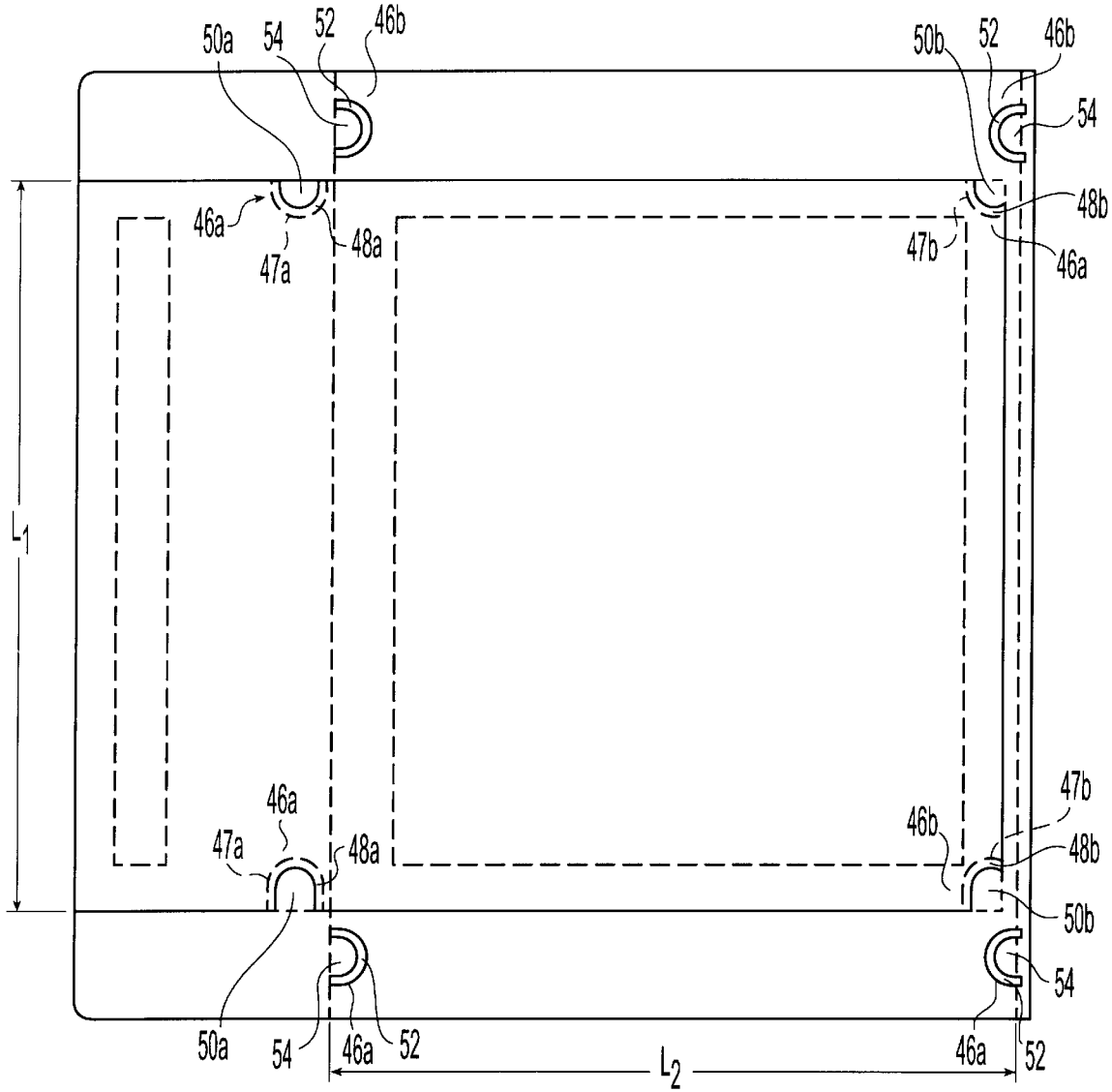
FIG. 5 is a top view of the mounting sheet of FIGS. 3 and 4.

Referring to the preferred embodiment shown in FIG. 5, the first set of fasteners 46*a* comprises left and right fasteners 47*a* and 47*b*. Preferably the left fasteners 47*a* are each located in a position proximate to the first fold line 18, such that when the mounting sheet 44 is inserted in the pocket 29, the fasteners 47*a* are substantially aligned in area of the pocket panel 29 between the first and second windows 38 and 42 covered by frames 36 and 40. The right fasteners 47*b* are preferably disposed proximate to the outer comers of the mounting sheet 44 such that when the mounting sheet 44 is inserted within the pocket 29, the fasteners 47*b* are located between the outer edge 32 of the front cover 12 and the first window 38 and are covered by the first frame 36.

Each of the fasteners 47*a* and 47*b* preferably comprises a tab 50*a, b*, respectively, integrally constructed with the mounting sheet 44. The mounting sheet 44 defines an opening space or die-cuts 48*a, b*. In securing the display sheet 33 to the mounting sheet 44 with the fasteners 47*a* and 47*b*, the tabs 50*a*, 50*b* and the mounting sheet 44, a slight downward pressure in applied on the display sheet 33, pressing the display sheet 33 toward the mounting sheet 44 while the mounting sheet 44 exerts an upward force against the display sheet 33, thus clamping the inserted portion of the display sheet 33 to the mounting sheet 44. The die-cuts 48*a*, 48*b* and 52 prevent creasing or bunching of the display sheet 33 at the point of attachment by providing a space for the inserted portions of the display sheet 33 to adjust to the opposing forces of the tabs 50*a*, 50*b* and the mounting sheet 44, while relieving stresses in the mounting sheet 44.

FIG. 5 also shows the left fasteners 47*a* having a semi-circular opening or die-cut 48*a* and a tab 50*a* abutting the die-cut and correspondingly shaped. This preferred configuration of the fasteners 47*a* is adapted for receiving the straight portion of display sheet 33. Preferably the right fasteners 47*b* have a die-cut 48*b* is preferably shaped as a quarter part of a circle and forms tab 50*b* of a corresponding shape. The configuration of die-cuts 47*b* and tabs 50*b* is better adapted to receive the comers of display sheet 33. Accordingly, the first set of fasteners 46*a* are configured to secure the display sheet 33 in a landscape orientation.

Similarly, the second set of fasteners 46*b* preferably has the same die-cut and tab construction of the first set of fasteners 46*a*. As shown in FIG. 5, die-cut 52 is preferably arcuate or substantially semi-circular in shape, and the tab 54 correspondingly has a semi-circular shape abutting the die-cut 52. As stated above, the second set of fasteners 46*b* hold the display sheet 33 in a portrait orientation. All of the die-cuts 52 and tabs 54 in the second set of fasteners 46*b* are preferably similarly shaped to easily receive the straight portions of the display sheet 33 although comer tabs similar to tabs 50*b* can also be used.

The positioning and the size of die-cuts 48*a, b* and tabs 50*a, b* is preferably selected so that the frame 36 covers the die-cuts 48*a, b* and tabs 50*a, b* when the mounting sheet 44 is inserted in the pocket 29. As the size of the folder 10 can be easily adapted to hold a variety of sizes of paper, the size of the frames 36 and 40 and the positions of the die-cuts 48*a, b* and tabs 50*a, b* are similarly adapted to hold the preferred size of display sheet 33, including the plurality of sheets 26 held or bound within the folder. Accordingly, users may print the display sheet along with a document on the same size sheets to be used with the folder.

The configuration of the fasteners 46 allow a conventionally sized sheet to be easily attached to and securely held in place by the mounting sheet 44, allowing flexibility in labeling the contents of the holder 10. The first and second sets of fasteners 46*a* and 46*b* are respectively disposed along spaced lines $L_1$ and $L_2$ that correspond to the dimensions of the display sheet 33, as shown in FIG. 5. Laser quality printing on conventional size sheets is readily available. By adapting the labeling of the binder for use with the commonly available printing process and by providing labeling of the front cover 12 only or front cover 12 and spine 16 in one easy step, the present invention greatly improves the versatility of identifying the contents of the folder as well as improving its overall appearance.

The mounting sheet 44 is preferably printed on one side with instructions to users for securing and inserting the display sheet 33 in the various positions. Additionally, the mounting sheet 44 can be used as a sell sheet featuring consumer information about the folder 10, including a picture of the folder, the size of the rings, and the UPC code. Preferably the folder 10 is sold with the mounting sheet 44 inserted in the pocket panel 28, displaying consumer information through the windows.

The folder 10 is preferably constructed of card board or bristol board and preferably covered by a pliable plastic material of polyvinyl chloride or polyethylene composition. The pocket panel 28 is preferably a flexible single ply plastic material that may be transparent, translucent, opaque or a combination thereof to protect while displaying the inserted display sheet 33. The most preferred material for the pocket panel is clear polyvinyl chloride with an "orange peel" texture. Alternatively, the folder 10 can be made of plastic and have living hinges.

The window frames 34 and 36 and windows 38 and 40 may be constructed from different materials secured to each other to form the pocket panel 28. Preferably the windows 38 and 40 and the window frames 34 and 36 are formed from a continuous sheet of pocket panel material where the window frames 38 and 40 are opaque and the windows are transparent. The windows 38 and 40 may additionally be cutouts from the panel material or the front cover 12 and the spine 16. The most preferred method of forming the window frames 34 and 36 and the windows 38 and 40 is by a silkscreen printing process, where the desired colors for the window frames are silkscreen printed onto the pocket panels. The use of both transparent and opaque plastic material is shown in FIG. 2, where pocket panel 28 has a first frame 36 of the opaque plastic material framing a first window 38 of a transparent material. The windows 38 and 40 may respectively be disposed over any portion of the front cover 12 and spine 16. Additionally, the windows 38 and 40 may have any shape. The windows 38 and 40 preferably has dimensions that corresponds to the display sheet 33 as well as the sheets 26 contained in the binder 11. Preferably, the windows 38 and 40 are smaller in dimensions than the display sheet, exposing portions of the display sheet 33. Most preferably, the windows 38 and 40 have dimensions such that the fasteners 46*a* and 46*b* are not shown with the exposed portions of the display sheet 33.

Preferably, first frame 36 and first window 38 are disposed on the pocket panel 28 of the front cover 12 such that the first window 38 exposes only a portion of the front cover 12. Similarly, the pocket panel 28 has a second frame 40 of the opaque plastic material framing a second window 42 of a transparent material. The second frame 40 and second window 42 are disposed on the pocket panel 28 such that the second window 42 exposes only a portion of the spine 16.

First and second frames 36 and 40 may be formed by silk-screening, hot stamping, appliqueing or other methods of applying an opaque coverage a portion of the pocket panel 28. Any color desired is suitable for use with the present invention. The method of applying the silk screen may differ depending on the color of the window frames desired. For example, where black window frames are desired, a single pass of black ink is usually sufficient to create the opaque quality to accentuate the displayed materials. Where a lighter color frame is desired with a light colored binder, such as white, it is preferable to print one layer of white ink and two more layers of light gray ink on top of the white ink after the white ink is allowed to dry. The use of the gray ink layers under the white ink layer insures an opaque, yet white, surface for the window frames.

The folder 10 is preferably dimensioned to accommodate conventionally sized sheets of papers with sufficient clearance to fully protect the sheets held therein from external elements. An example of such sheets of paper is the standard 8½ by 11 inch sheets of paper, commonly used in the U.S., or A4 size. To accommodate standard 8½ by 11 inch sheets of paper, the front and back covers preferably are 10-¼ by 11-⅝ inches. In addition to accommodating the size of the sheets contained in the folder 10, the dimension of the spine 16 is selected to accommodate the variable thicknesses of the stack of sheets 26 that may be held within the folder 10.

The dimensions of the first and second frames 36 and 40 are selected to cover a portion of the display sheet 33, according to the size of the inserted sheet. The dimensions of the windows 38 and 42 are selected corresponding to the size of frames 36 and 40, front cover 12 and spine 16. Preferably the size of the windows 38 and 42 are dimensioned to maximize the displayed area of the display sheet, while covering the fasteners. Since the dimension of the second frame 40 depends on the size of the spine 16, the window 42 size will likewise vary. For a folder having a one inch holding capacity, the first window 38 preferably has a dimension 7.25 inches in width by 8 inches in length, and the second window 42 preferably has a dimension 0.625 inches in width by 8 inches in length. For a folder having a two-inch holding capacity, the first window 38 preferably has a dimension 7.25 inches in width by 8 inches in length, and the second window 42 preferably has a dimension 0.75 inches in width by 8 inches in length. Moreover, although first and second frames 36 and 40 are shown as having a substantially rectangular shape, other shapes can be employed, including circular, oval, or irregular, to display a different display area shape of the display sheet.

Figure 6:
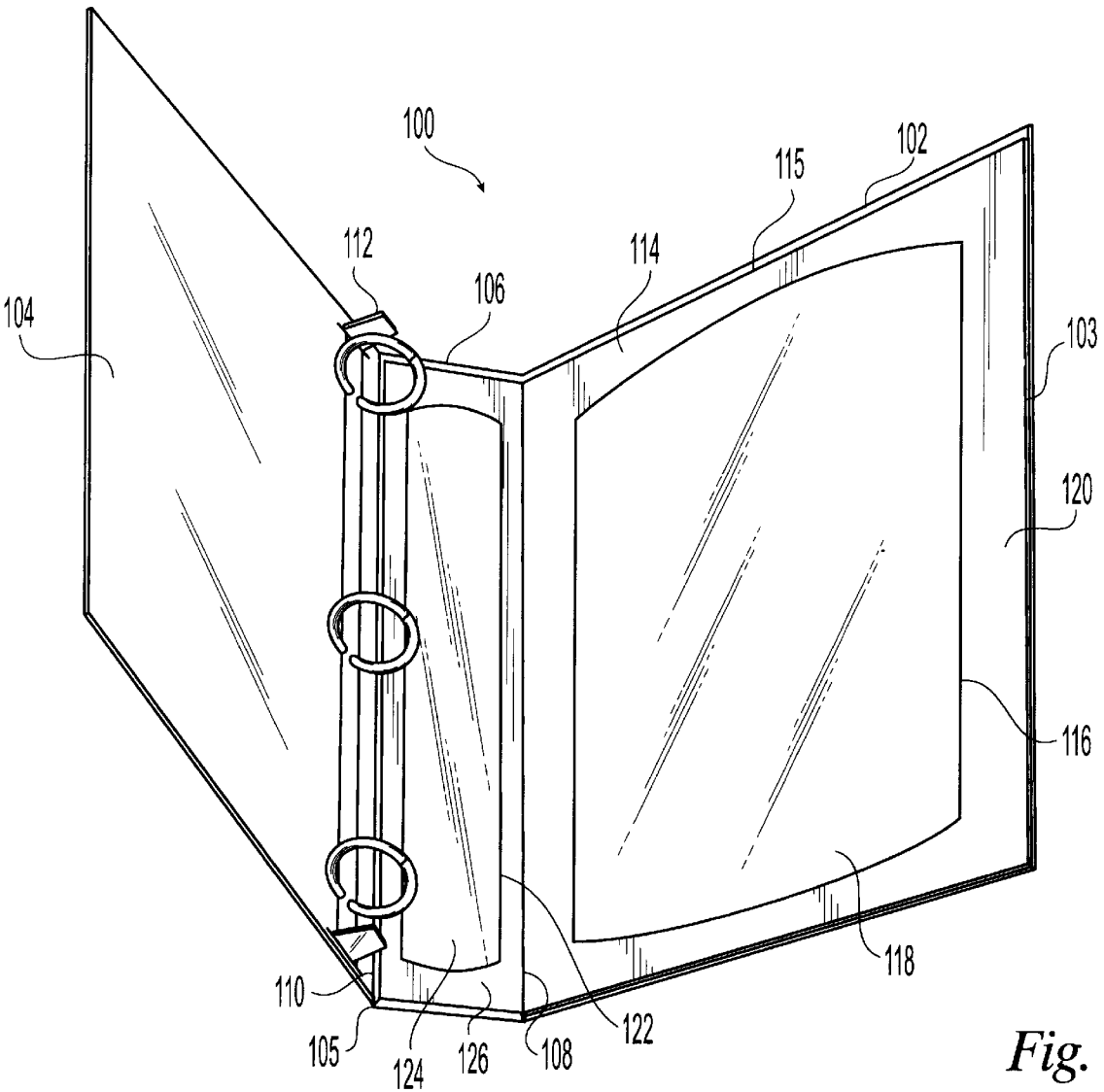
FIG. 6 is a perspective view of another embodiment of a folder according to the present invention.

Another embodiment of a folder 100 according to the present invention is shown in FIG. 6. Folder 100 is shown having a front cover 102, a back cover 104 and a spine 106 disposed therebetween respectively forming a front and back fold lines 108 and 110 along the interfaces with the front and back covers 102 and 104. A ring mechanism 112 is preferably attached to the inside surface of the back cover 104 proximate to the back fold line 110. As shown, a pocket panel 114 is secured to the inside surface of the folder 100 along the outer edge of the front cover 102 forming a first seal line 103. The pocket panel 114 is also secured to the inside surface of the folder 100 along the back fold line 110, forming a second seal line 105. The pocket panel 114 forms a pocket 115 to allow the insertion of a display sheet 33. The pocket panel 114, however, can alternatively be secured to the outside surface of the folder 100. A first cut-out 116 is disposed on the front cover 114 forming a first window 118 and a first frame 120. A second cut-out 122 is disposed on the spine 106 forming a second window 124 and a second frame 126. Windows 118 and 124 and frames 120 and 126 provide coverage to a portion of the front cover 114 and the spine 106, allowing exposure and framing of the display portion of the display sheet preferably containing content information when inserted. The windows 118 and 124 of this embodiment is shown as having arched top and bottom sides. As with the first embodiment, windows 118 and 124 having other shapes are also suitable.

Figure 7:
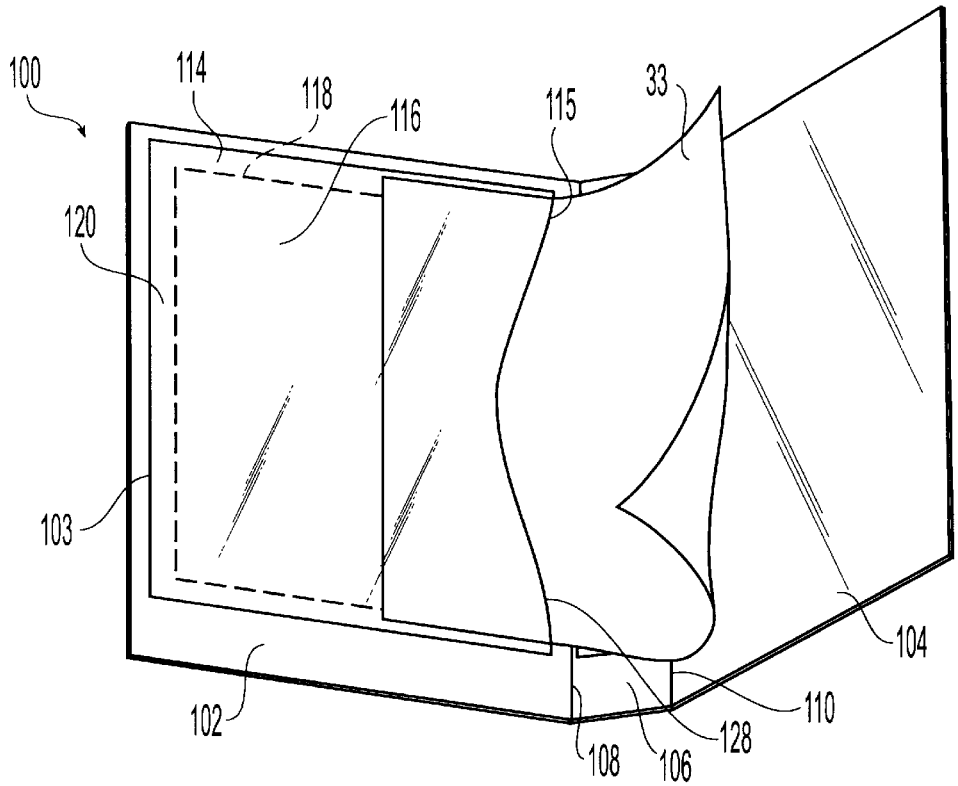
FIG. 7 is a top view of the folder of FIG. 6 in an open position showing the first step of inserting a sheet into the holder.
Figure 8:
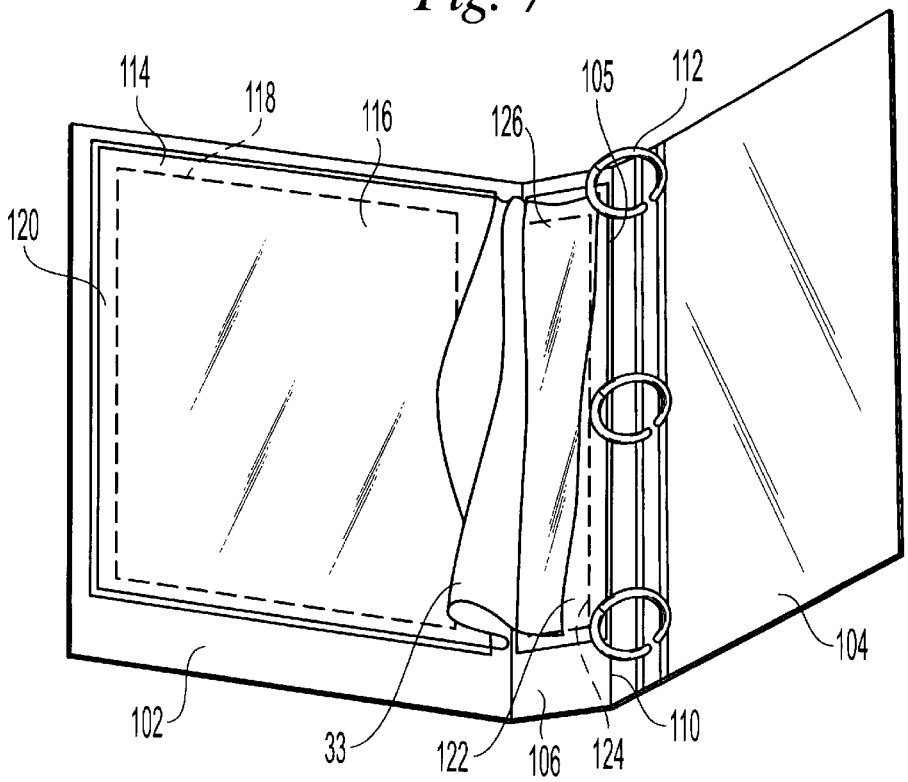
FIG. 8 is a top view of the folder of FIG. 6 in an open position showing the second step of inserting the sheet into the holder.

Referring now to FIGS. 7 and 8, the pocket panel 114 is shown having an opening 128 along the front fold line 108, allowing the insertion of the display sheet 33 within the pocket 114. FIG. 7 shows a first step in inserting the display sheet 33 of paper into the pocket panel 114 where the title page side of the paper is inserted in the front cover 112 portion of the pocket 114. A second step involves inserting the spine label side of the display sheet 33 into the spine 106 portion of the pocket panel 114, as shown in FIG. 8. Once inserted, the frames 120 and 126 frame the information contained on the display sheet 33 and expose only the portion of the display sheet 33 through windows 118 and 124.

The folders described above may be manufactured by various automated and continuous assembly line methods. As each folder is manufactured in a similar fashion as the others, the following describes the preferred method of manufacturing a folder 200 according to the present invention. In this preferred method, a plurality of folder parts are pre-dimensioned and configured for assembly.

Figure 9:
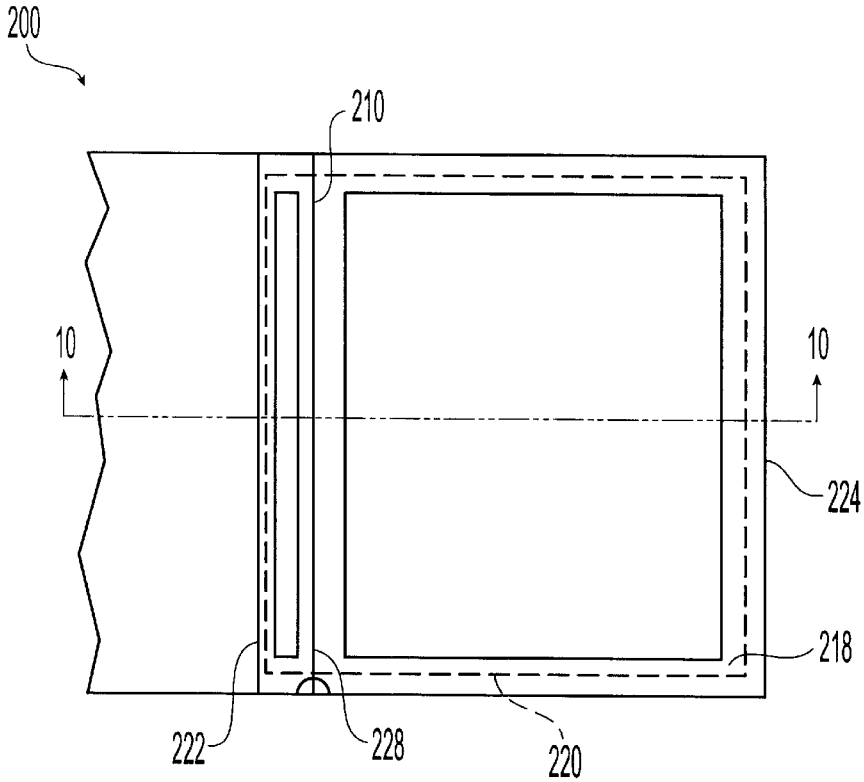
FIG. 9 is a top view of a folder constructed according to the present invention.

Preferably a pre-dimensioned and configured board 202, having a front cover 204, a back cover 206 and a spine 208 disposed therebetween respectively defining a front fold line 210 and a back fold line 212 with the front and back covers 204 and 206, is placed on an assembly table, as shown in FIG. 9. The board 202 is layered between two binder cover materials 214 to form a base 216. An mounting material 218 formed or cut as the mounting sheet 44 is located over the front cover 204 and spine 208 portions of the previously formed base 216. Preferably the mounting material 218 is constructed of a pliable and transparent or translucent material composed of polyvinyl chloride or polypropylene. Additionally, the mounting material 218 is formed with fasteners and printed display information. The pocket panel material 220 is placed over the assembly of mounting material 218 and base 216.

Figure 10:
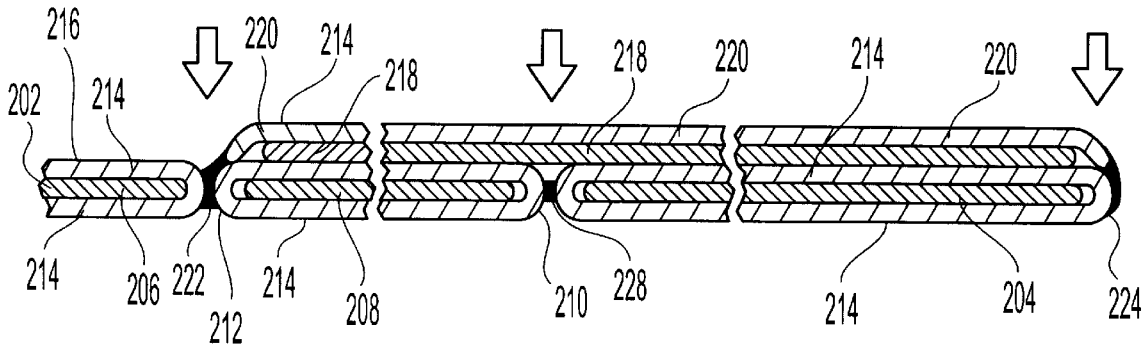
FIG. 10 is a cross-sectional view of the folder of FIG. 9 along line 10—10.

The pocket panel material 220 is then fixed to the base 216 to form sealed side edges 222 and 224 that are substantially in alignment with the back fold line 212 and the outer edge 226 of the front cover 204 as shown by the arrows in FIG. 10. Additionally, a third seal line 228 is formed substantially in alignment with a hinge line 230 formed between the front cover 204 and the spine 208. The third seal line 228 is fixed to the base 216, as shown by the arrows along the font fold line 210, such that the pocket material 220 is not secured to the base 216 or the mounting material 218.

The selection of the mounting material 218 prevents such attachment of the pocket panel to the binder. The method of fusing may be provided by various systems well known in the art including, heat, sonic, ultrasonic, or mechanical methods. The most preferred method of fusing the pocket panel material is through radio frequency welding. Other methods of fixing the pocket material to the binder cover includes heat sealing, stitching, stamping, snapping, riveting, adhering, pressing and fastening by adhesives. As shown in the preferred embodiment, the use of the plastic coated paper, commercially known as a Yupo sheet, prevents such attachment due to the Yupo sheet's resistance to radio frequency welding. Preferably, the mounting material 218 and the cover material 214 are selected such that the two materials will not become fixed by the fixing method used to fix the pocket sheet 220 to the cover 204.

One of ordinary skill in the art can envision numerous variations and modifications to the invention disclosed herein. All of these modifications are contemplated by the true spirit and scope of the following claims.

What is claimed is:

1. A folder comprising:

a) a cover having an exterior surface and having first and second panels pivotably associated with each other; and b) a mounting portion associable with the first and second panels for mounting a display sheet extendable across both the first and second panels, the mounting portion including at least one first fastener configured and disposed to secure the display sheet in a first position relative to the mounting portion;

wherein at least a portion of the display sheet is visible from the exterior surface of the cover when the display sheet is in the first position.

2. The folder of claim 1 wherein the display sheet in the first position extends only over the first and second panels.

3. The folder of claim 1, wherein the mounting portion further comprises at least one second fastener configured and disposed to secure the display sheet in a second position relative to the mounting portion, wherein the display sheet extends over only one of the first and second panels.

4. The folder of claim 1, wherein the mounting portion comprises:

a) a pocket panel connected to the cover defining a pocket therebetween; and b) a mounting sheet receivable within the pocket wherein the at least one first fastener is disposed on the mounting sheet.

5. The folder of claim 3, wherein the display sheet in the first position is in a first orientation and in the second position in a second orientation.

6. The folder of claim 3, wherein the display sheet in the second position is disposed only over the first panel.

7. The folder of claim 3, wherein:

a) the at least one first fastener includes a plurality of first fasteners disposed along first lines spaced from each other by a first distance corresponding to a dimension of the display sheet;

b) the at least one second fastener includes a plurality of second fasteners disposed along second lines spaced by the first distance; and c) the first and second lines are disposed at an angle with respect to each other.

8. The folder of claim 3, wherein the mounting portion includes a base, and the first and second fasteners include tabs associated with the base for receiving and holding the display sheet between the tabs and the base.

9. The folder of claim 5, wherein the first orientation is substantially perpendicular to the second orientation.

10. The folder of claim 6, wherein the first panel is one of a front and back cover and the second panel is a spine.

11. The folder of claim 7, wherein the angle is about 90°.

12. The folder of claim 8, wherein the mounting portion defines openings disposed between the tabs and the base for reducing deformation of the mounting portion when the display sheet is inserted between the tabs and the base.

13. The folder of claim 12, further comprises:

a) a first window frame defining a first window disposed only over the first panel; and b) a second window frame defining a second window disposed only over the second panel;

wherein the first panel is a front cover of the folder, the second panel is a spine of the folder, and the first window exposes only a first portion of the display sheet over the front cover, and the second window exposes only a second portion of the display sheet over the spine.

14. The folder of claim 4, wherein:

a) the first and second panels are pivotably connected at a hinge; and b) the pocket panel is attached to the first and second panels such that the pocket panel is free from attachment about the hinge.

15. The folder of claim 13, wherein the first and second windows are disposed on the pocket panel.

16. The folder of claim 13, wherein:

a) the display sheet has a display sheet length; and b) the first and second windows have a first window length extending laterally across the cover and including both windows;

wherein the display sheet length is greater than the first window length.

17. The folder of claim 15, wherein the pocket panel includes a window frame substantially overlapping with at least one fastener.

18. The folder of claim 17, wherein the mounting sheet comprises first and second groups of fasteners wherein:

a) the mounting sheet and the first group of fasteners are configured for securing the display sheet in the first position extends substantially over the first and second panels and respectively exposing the first and second portions of the display sheet within the first and second windows; and b) the mounting sheet and the second group of fasteners are configured for securing the display sheet in the second position extending substantially over the first panel and exposing the first and second portions of the display sheet within only the first window.

19. The folder of claim 14, wherein:

a) the first panel has a first outer edge disposed laterally opposite from the hinge; and b) the second panel has a second outer edge disposed laterally opposite from the hinge;

wherein the pocket panel is attached to the first and second panels proximate to the first and second outer edges.

20. The folder of claim 14, wherein the pocket panel has an opening disposed substantially about the hinge for receiving the display sheet.

21. The folder of claim 19, wherein the pocket panel defines a notch disposed at the hinge preventing the pocket panel from gathering when the first and second panels pivot about the hinge.

22. The folder of claim 20, wherein the opening forms a first pocket part and a second pocket part such that the first and second pocket parts open toward each other about the hinge.

23. The folder of claim 22, wherein:

a) the opening comprises a first side abutting the first pocket part and a second side abutting the second pocket part; and b) the display sheet has a first edge and a second edge disposed laterally opposed to the first edge;

wherein the first edge of the display is insertable within the first pocket part, and the second edge of the display sheet is insertable within the second pocket part.

24. A folder comprising:

a) a cover having first and second panels pivotably associated with each other;

b) a binder mechanism attached to the cover and configured for binding sheets having predetermined dimensions with the predetermined dimensions oriented in a bound orientation; and c) a mounting portion for receiving a display sheet having said predetermined dimensions, the mounting portion having at least one fastener formed thereon and configured and dimensioned for mounting the display sheet with the predetermined dimensions oriented in a display orientation, wherein the display orientation is disposed at an angle with respect to the bound orientation.

25. The folder of claim 24, wherein the angle between the display and bound orientations is more than about 45°.

26. The folder of claim 24, wherein one of the display and bound orientations is portrait and the other is landscape.

* * * * *